United States Patent [19]

Barr et al.

[11] Patent Number: 4,942,933

[45] Date of Patent: Jul. 24, 1990

[54] RELATING TO ROTARY DRILL BITS

[75] Inventors: John D. Barr; Michael T. Wardley, both of Gloucestershire, England

[73] Assignee: Reed Tool Company, Ltd., Dyce, Northern Ireland

[21] Appl. No.: 250,930

[22] Filed: Sep. 29, 1988

Related U.S. Application Data

[63] Continuation-in-part of Ser. No. 129,943, Nov. 25, 1987, abandoned, which is a continuation of Ser. No. 931,647, Nov. 17, 1986, abandoned.

[30] Foreign Application Priority Data

May 6, 1988 [GB] United Kingdom ..... 8810751

[51] Int. Cl.[5] ..... E21B 10/46

[52] U.S. Cl. ..... 175/329; 175/410

[58] Field of Search ..... 175/329, 330, 410, 414, 175/415

[56] References Cited

U.S. PATENT DOCUMENTS

| | | | |
|---|---|---|---|
| 4,343,372 | 8/1982 | Kinzer | 175/410 |
| 4,505,342 | 3/1985 | Barr et al | 175/410 |
| 4,593,777 | 6/1986 | Barr | 175/410 |
| 4,669,556 | 6/1987 | Barr et al. | 175/410 |
| 4,679,639 | 7/1987 | Barr et al. | 175/410 |

FOREIGN PATENT DOCUMENTS

| | | | |
|---|---|---|---|
| 2151283 | 7/1985 | United Kingdom | 175/329 |

*Primary Examiner*—Bruce M. Kisliuk
*Assistant Examiner*—Terry Lee Melius
*Attorney, Agent, or Firm*—Browning, Bushman, Zamecki & Anderson

[57] ABSTRACT

A rotary drill bit for use in drilling or coring holes in subsurface formations comprises a bit body having a shank for connection to a drill string, a plurality of cutter assemblies mounted at the surface of the bit body, and a passage in the bit body for supplying drilling fluid to the surface of the bit body for cooling and cleaning the cutter assemblies. At least some of the cutter assemblies each comprise a cutting element on a stud which is recveived in a socket in the bit body, the centerline of the stud being disposed at an angle to the normal direction of forward movement of the cutter assembly in use of the bit. At least three of such cutter assemblies are disposed closely adjacent one another in a row, adjacent cutter assemblies in the row having their centerlines inclined at different angles to allow closer packing of the cutter assemblies.

13 Claims, 3 Drawing Sheets

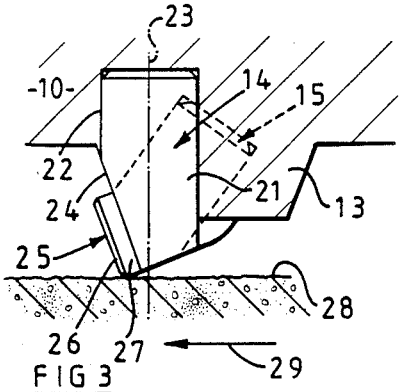
FIG 3
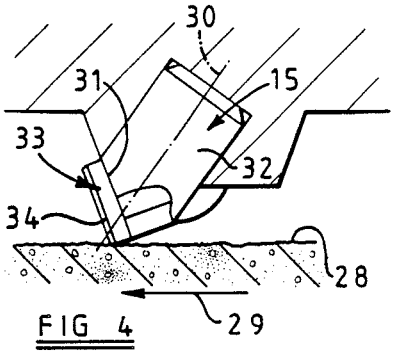
FIG 4
FIG 5
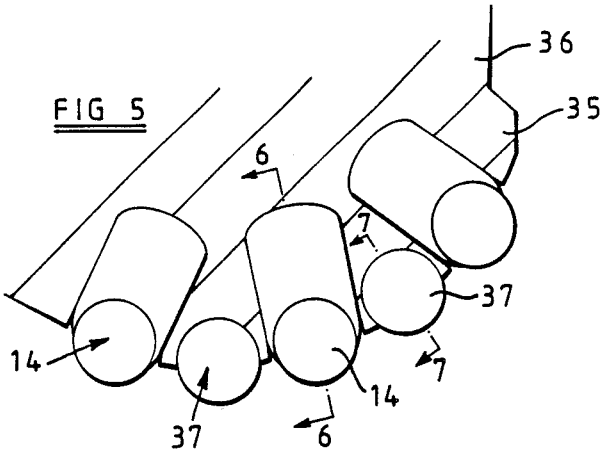
FIG 6
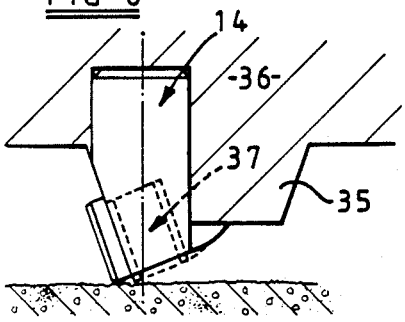
FIG 7
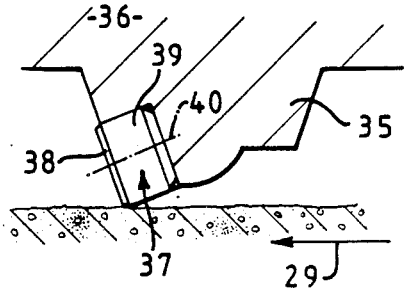

RELATING TO ROTARY DRILL BITS

CROSS REFERENCE TO RELATED APPLICATIONS

This is a continuation-in-part of U.S. Application Ser. No. 129,943 filed Nov. 25, 1987, now abandoned, which in turn is a continuation of U.S. application Ser. No. 931,647 filed Nov. 17, 1986, and now abandoned.

BACKGROUND OF THE INVENTION

1. Field of the Invention

The invention relates to rotary drill bits for use in drilling or coring holes in subsurface formations and of the kind comprising a bit body having a shank for connection to a drill string, a plurality of cutter assemblies mounted at the surface of the bit body, and a passage in the bit body for supplying drilling fluid to the surface of the bit body for cooling and cleaning the cutter assemblies.

2. Description of the Background

In a common form of such bit, each cutter assembly comprises a mounting body which is received in a socket in the surface of the bit body, the mounting body having a cutter portion at one end thereof. The mounting body may comprise a separately formed stud generally in the form of a cylinder of constant cross section, the cutting portion being provided by a preform cutting element mounted on a plane surface at one end of the stud which is inclined to the centerline of the stud, or is at right angles thereto.

The preform cutting element may be of the kind comprising a tablet, often circular or part-circular, having a thin, hard cutting layer of polycrystalline diamond bonded to a thicker, less hard backing layer, for example, of tungsten carbide. However, preform cutting elements are also known which consist of a unitary body of thermally stable polycrystalline diamond.

Alternatively, instead of the preform cutting element being mounted on a separately formed stud, it may be integrally formed with a backing layer of sufficient thickness for the backing layer itself to form the mounting body which is received in a socket in the bit body.

The bit body may be machined from metal, usually steel, in which case the sockets for the cutter assemblies may conveniently be machined in the surface of the bit body. In another common form of bit, the bit body, or a part thereof, is molded using a powder metallurgy process. In this case, the sockets are usually formed in the bit body during the molding process and may or may not be subject to further machining operations before the cutter assemblies are mounted on the bit body.

In either type of bit, it is necessary, in order to provide adequate strength to the mounting of the cutter assemblies in the bit body, to provide a certain minimum thickness of bit body material between adjacent sockets. Since cutter assemblies are often required to be disposed side-by-side in rows along convexly curved portions of the bit body, the inner ends of adjacent sockets are closer together than the outer ends and, consequently, it may often not be possible to arrange the cutting portions, on the projecting outer ends of the mounting bodies, as close together as is desirable.

Attempts have been made to overcome this problem by mounting preform cutting elements on studs which are noncircular in cross section. For example, by using studs which are of generally rectangular or similar cross section, the cutting elements may be packed together more closely in the bit body than when mounted on studs of circular cross section. However, the corresponding non-circular sockets may be difficult and costly to manufacture to the required accuracy. Also, in order to achieve the close packing, the thickness of bit body material between adjacent studs still requires to be small and this may be a cause of weakness in the bit.

The present invention sets out to provide an arrangement whereby adjacent cutter assemblies may be packed together closely side-by-side on the bit body, while avoiding the disadvantages of the known arrangements.

SUMMARY OF THE INVENTION

According to the invention, there is provided a rotary drill bit for use in drilling or coring holes in subsurface formations comprising a bit body having a shank for connection to a drill string, a plurality of cutter assemblies mounted at the surface of the bit body, and a passage in the bit body for supplying drilling fluid to the surface of the bit body for cooling and cleaning the cutter assemblies, at least some of said cutter assemblies each comprising a cutting portion on a mounting body which is received in a socket in the bit body, the mounting body having a centerline disposed at an angle to the normal direction of forward movement of the cutter assembly in use of the bit, and at least three of the cutter assemblies being disposed closely adjacent one another in a row, each two adjacent cutter assemblies in said row of at least three having the centerlines of their mounting bodies inclined at different angles to said normal direction of forward movement thereof.

Since adjacent cutter assemblies have their centerlines inclined at different angles, there may be provided an angular separation between adjacent mounting bodies which increases the further the bodies extend into the bit body. This can, therefore, permit a comparatively large distance between the inner ends of adjacent mounting bodies, to provide a substantial body of material between the inner ends of the bodies. In addition, the difference in inclination of adjacent mounting bodies may permit one or both of the bodies to extend more deeply into the bit body material than the other, and this also may allow closer packing of the cutting portions without detriment to the strength of the bit body around the cutter assemblies.

The difference in inclination between the centerlines of said adjacent cutter assemblies is preferably greater than 30°, and more preferably greater than 35°.

One of said two adjacent cutter assemblies may have its centerline inclined at substantially 90° to said normal direction of forward movement, and the other of said cutter assemblies may have its centerline inclined at less than 90° to said normal direction of forward movement so as to be inclined rearwardly with respect to said direction.

Preferably, each said cutting portion has a front cutting face, and the front cutting faces on said two adjacent cutter assemblies are inclined at substantially the same angle to said normal direction of forward movement of the cutter assemblies in use.

In a preferred embodiment, at least some of said cutter assemblies each comprise a preform tablet having a front cutting face of polycrystalline diamond material and a rear face bonded to a surface on a carrier. The preform tablet may comprise a thin, hard facing layer of polycrystalline diamond material bonded to a less hard backing layer, the backing layer having a rear face bonded to said surface on the carrier. Also, at least some of said cutter assemblies may each comprise a thin, hard facing layer of polycrystalline diamond material bonded to a less hard backing layer, the diamond layer thereby constituting said cutting portion and the backing layer constituting said mounting body.

One of said two adjacent cutter assemblies may have said front cutting face thereof extending substantially at right angles to the centerline of the mounting body of the cutter assembly.

In any of the above arrangements, alternate cutter assemblies in the row may have the centerlines thereof inclined at a first or a second angle respectively to the normal direction of forward movement thereof.

BRIEF DESCRIPTION OF THE DRAWINGS

FIGS. 3 and 4 are lengthwise sections through adjacent cutter of the drill bit of FIGS. 1 and 2;

FIG. 5 is a sectional view of part of an alternative form of drill bit, the cutter assemblies again being shown isometrically;

FIGS. 6 and 7 are lengthwise sections through adjacent cutter assemblies of the drill bit of FIG. 5 taken on lines 6—6 and 7—7, respectively;

DETAILED DESCRIPTION OF THE PREFERRED EMBODIMENTS

Figure 1:
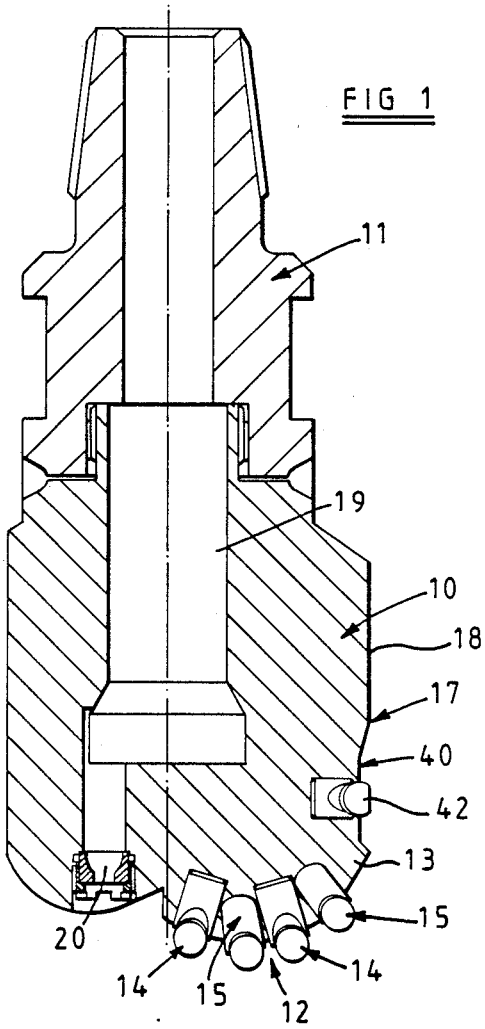
FIG. 1 is a vertical section through a rotary drill bit according to invention, the cutter assemblies being shown isometrically.
Figure 2:
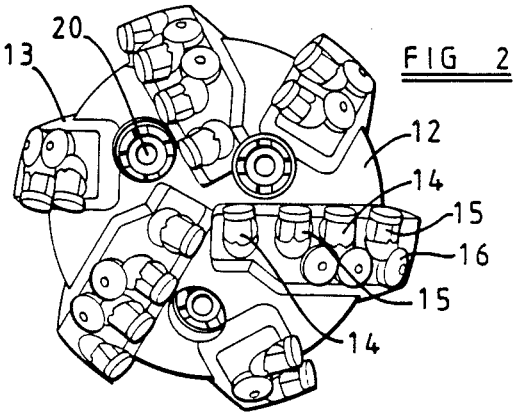
FIG. 2 is an end view of the drill bit of FIG. 1.

Referring to FIGS. 1 and 2, the bit body 10 includes a separately formed shank portion 11 at one end for connection to the drill string. The bit body shown is molded by a powder metallurgy process, in known manner. The surface of the bit body 10 comprises an operative end face 12 and a laterally facing portion 40.

The operative end face 12 of the bit body 10 is formed with six blades 13 radiating from the central area of the bit and the blades carry cutter assemblies 14, 15 and 16 spaced apart along the length thereof. The cutter assemblies are of three different types as will be described in greater detail hereafter.

The laterally facing portion 40 of the surface of the bit body defines a gauge section 17 including kickers 18 which contact the walls of the borehole being drilled to stabilize the bit in the borehole. Laterally extending or gauge cutter assemblies, one of which is shown at 42, are mounted at the laterally facing portion 40 of the surface of the bit body 10 below kickers 18. Cutter 42 may be similar to cutters 14 described below, but of slightly modified shape, or of any other suitable type. A central passage 19 in the bit body and shank delivers drilling fluid to nozzles 20 in the end face 12 of the bit body, in known manner.

It will be appreciated that this is only one example of the many possible variations of the type of bit to which the invention is applicable, including bits where the body is machined from solid metal, usually steel. Alternative constructions and methods of manufacturing such bits are well known in the art and will not therefore be described in detail.

Along the leading edge of each blade 13 there are disposed side-by-side, in a row, a number of cutter assemblies, alternate cutter assemblies in the row being indicated at 14 and 15, respectively.

FIG. 3 shows diagrammatically a cutter assembly of the type indicated at 14 in FIGS. 1 and 2. The cutter assembly comprises a generally cylindrical stud 21 of circular cross section received in a correspondingly-shaped socket 22 in the bit body 10. The centerline of the stud is indicated at 23. The stud may be formed from cemented tungsten carbide.

Adjacent its outer end, the stud 21 is formed at one side with a flat plane 24 which is inclined with respect to the centerline of the stud. Bonded onto the plane surface 24 is a cutting element 25 in the form of a circular tablet. The cutting element comprises a thin, hard facing layer 26 of polycrystalline diamond bonded to a thicker backing layer 27 of cemented tungsten carbide.

The formation on which the cutting element 25 is acting is indicated at 28, and the normal direction of forward movement of the cutter assembly during operation of the drill bit is indicated by the arrow 29. It will thus be seen that the centerline 23 of the stud 21 and of the socket 22 extends at right angles to the formation and to the normal direction of forward movement 29.

FIG. 4 illustrates the alternative type of cutter assembly 15. The components making up the cutter assembly 15 are generally similar to the components of the assembly 14 and will not therefore be described in detail. However, it will be seen that the centerline 30 of each cutter assembly 15 is inclined at less than 90° to the normal forward direction 29 of movement of the cutter assembly in use, for example, is inclined at 45° to such direction. However, the plane surface 31 of the stud 32 on which the cutting element 33 is mounted is inclined at such an angle to the centerline 30 of the stud that the front cutting face of the polycrystalline diamond layer 34 of the cutting element is inclined at the same angle to the formation 28 as the front cutting face of the cutting element 25 of the cutter assembly 14.

FIG. 3, as well as showing a cutter assembly 14, also shows, in dotted lines, the orientation of an adjacent cutter assembly 15. It will be seen from this that the difference in inclination between the centerlines of the adjacent cutter assemblies (which is preferably greater than 30°) results in the inner ends of the studs 21 and 32 of the cutter assemblies being increasingly spaced apart as they extend into the bit body 10. Each stud is therefore surrounded, at least at its inner end, by a thicker body of material than would be the case if the centerlines of adjacent cutter assemblies were to be inclined at the same angle to the direction of normal forward movement of the cutters, as has been the case hitherto.

The cutter assemblies 16 shown in FIG. 2 are disposed rearwardly of the cutter assemblies 14 and 15 with respect to the normal direction of rotation of the bit. The cutter assemblies 16 are back-up assemblies comprising bosses, for example, of cemented tungsten carbide, impregnated with natural diamonds. Although such back-up cutter assemblies will not normally require to be sufficiently closely spaced to require the arrangement according to the present invention, the invention includes within its scope arrangements in which two such adjacent cutters have their centerlines inclined at different angles with respect to the normal direction of forward movement.

In the arrangement shown in FIGS. 3 and 4, the cutting elements 25 and 33 are two-layer preform cutting elements comprising a layer of polycrystalline diamond bonded to a backing layer of cemented tungsten carbide. As is well known, such preform cutting elements are formed in an extremely high pressure, high temperature press and the preform elements are subsequently bonded, for example, by brazing, to the studs. However, the present invention is not limited to the use of such preform cutting elements which are shown only by way of example.

FIGS. 5–7 show an alternative form of drill bit in which cutting elements of the type 14 shown in FIG. 3 are alternated along the blade 35 on the bit body 36 with a further type of cutter assembly 37.

As best seen in FIG. 7, the cutter assembly 37 comprises a hard facing layer 38 of polycrystalline diamond bonded to a thick tungsten carbide backing layer 39. The centerline 40 of the cutter assembly is inclined at about 20° to the normal forward direction of movement 29 of the cutter assembly. In this case, the front cutting face of the polycrystalline diamond layer 38 extends at right angles to the centerline 40 of the cutter assembly, and the angle of inclination of the centerline 40 is selected to provide an angle of inclination (known as the "back rake" angle) between the front cutting face and the normal to the formation which is essentially the same as the back rake angle of the cutter assembly 14.

FIG. 6 shows a cutter assembly 14 of the arrangement of FIG. 5 and also shows an adjacent cutter assembly 37 in dotted lines. It will be seen that, in this case, interference between the cutter assemblies 14 and 37 is avoided not only by virtue of the difference in the angles of inclination of centerlines 23 and 40 but also by limiting the axial length of the cutter assembly 37 and hence the extent to which it projects into the bit body 36.

The cutter assembly 37 may be of a known kind in which the two-layer cutting element is formed in the abovementioned high pressure, high temperature press but with the backing layer 29 being of substantially greater thickness than is the case in the cutting elements such as shown, for example, at 25 and 33 in FIGS. 3 and 4. In the case of such a cutter, the front polycrystalline diamond layer 38 may be regarded as the cutting portion and the backing layer 39 onto which it is bonded in the press may be regarded as the mounting body of the cutter assembly. However, the invention also includes within its scope arrangements in which the two-layer structure shown at 37 is bonded to a further cylindrical tungsten carbide stud which extends coaxially with the backing layer 39 and rearwardly thereof.

It will be appreciated also that a similar cutter assembly may be formed by bonding a thin, two-layer preform cutter of the kind shown at 25 and 33 to an equal diameter cylindrical tungsten carbide stud, the cutting element being bonded to the circular end face of the stud so as to be coaxial therewith.

It should be noted that the views shown in FIGS. 1 and 5 are not true sections through the blades on which the cutter assemblies are mounted since, for clarity, the cutter assemblies are shown isometrically.

In the preceding embodiments, virtually all of the primary cutter assemblies, i.e. the polycrystalline diamond layered assemblies 14, 15 and 37, as opposed to the back-up assembly 16, are arranged in rows with alternate cutting assemblies having the centerlines of their mounting bodies disposed at alternately different angles of inclination along the entire length of each row. However, the principles of the present invention can be used to advantage by providing such alternating angles of inclination only on a limited portion of a bit.

For example, in some bits, and depending upon the formations in which such bits are to be used, it may not be necessary to provide such close spacing of the radially innermost cutter assemblies as is desirable among the radially outermost cutter assemblies on the operative end face of the bit; furthermore, it may be desirable to provide extra support for the radially outermost cutters if they are more taxed during the actual drilling conditions. Also, there may be portions of a bit in which, even at the radially outermost extremities of the operative end face, the nature and/or intended function of the cutters or cutter assemblies does not require the use of alternating angles of inclination.

In any event, however, it is desirable, when the nature of a bit, its cutter assemblies and/or the conditions in which it is to drill present the problems addressed by the present invention, that at least three of the cutter assemblies be disposed closely adjacent one another in a row, with each two adjacent ones of such cutter assemblies having the centerlines of their mounting bodies inclined at different angles of inclination.

Figure 9:
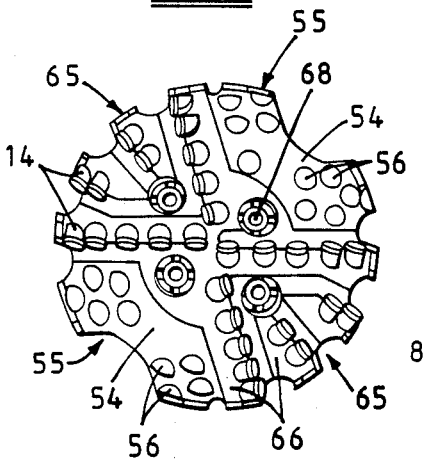
FIG. 9 is a diagrammatic end view of the bit shown in FIG. 8.
Figure 8:
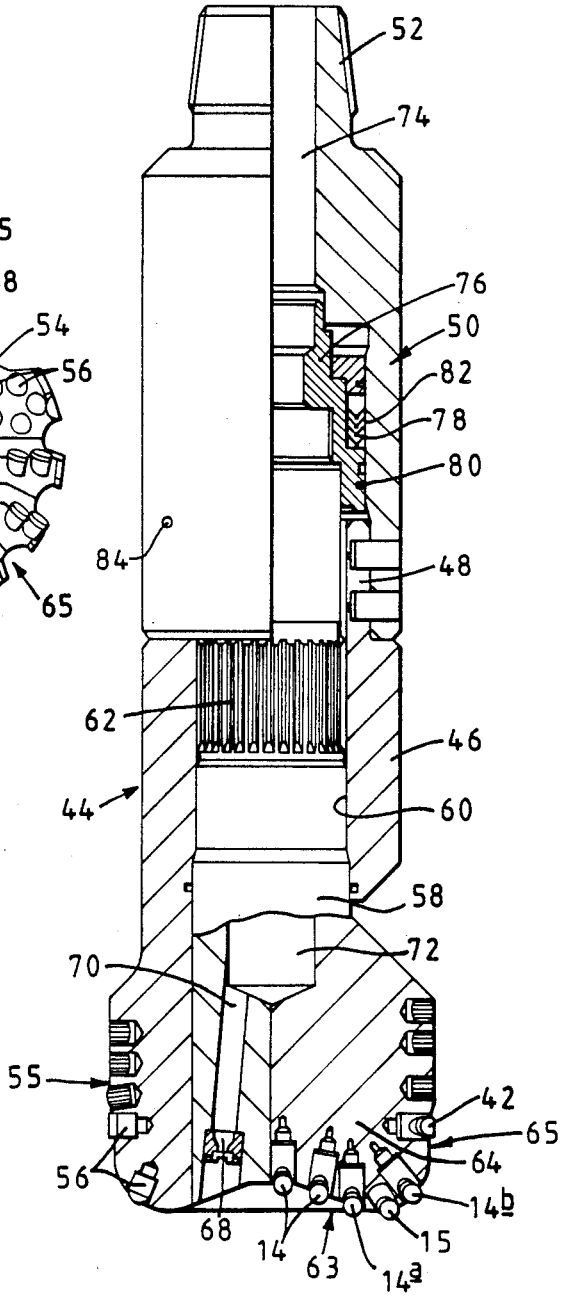
FIG. 8 is a diagrammatic vertical section through a drill bit in accordance with another embodiment of the invention.

FIGS. 8 and 9 illustrate a way in which the present invention can be selectively applied only to certain portions of a drill bit.

The main bit body 44 comprises an outer fixed part 46 having at its upper end a reduced diameter portion 48 which is secured within the lower end of a sub-assembly 50, the upper end of which is formed with a threaded shank 52 for connection to the drill string.

At its lower end, the surface of the fixed part 46 is formed with two end face portions 54 and two laterally facing portions 55. On end face portions 54, there are mounted abrasion elements 56. The abrasion elements 56 may be of any suitable form, for example, they may comprise tungsten carbide studs in which are embedded particles of natural diamond. The end face portions, and the abrasion elements thereon, constitute a secondary cutting structure.

A movable central part 58 of the bit is axially slidable within a bore 60 in the part 46, interengaging splines 62 on the part 58 and in the bore 60 being provided for the transmission of torque between the two parts. The lower end of the movable part 58 is formed with a head portion 64, the surface of which has end face 63 and laterally facing portions 65. On end face 63, there are provided blades 66 which carry preform cutter assemblies 14 and 15, and the cutter assemblies 14 and 15 on its end face 63 constitute the primary cutting structure of the bit. Laterally extending cutter assemblies 42 are carried at laterally facing portions 65 of the head 64 of the movable part 58 of the bit. Nozzles 68 mounted in the end face 63 of the head portion 64 communicate through passages 70 with a central passage 72 in the movable part 58 of the bit, which passage communicates in turn with a central passage 74 in the subassembly 50. In use of the bit, drilling fluid under pressure is supplied through the passage 74, passage 72, passages 70 and nozzles 68 for cleaning and cooling the cutters.

A piston assembly 76, including a heavy duty seal 78 and scraper ring 80, is mounted on the upper end of the movable bit body part 58 and is slidable within a cylinder 83 integrally formed with the sub-assembly 50. The lower end of the cylinder 82 is in communication, through low pressure link passages 84, with the annular space between the sub-assembly 50 and the walls of the bore, (normally referred to as the annulus).

The cutter assemblies 14 and 15 mounted on the end face 63 may be susceptible to overheating, and consequent damage or failure, as a result of excessive weight-on-bit and/or excessive torque and the configuration of the bit is such as automatically to compensate for such excessive loads. The configuration also protects the cutters against momentary overloads due to impact, for example, as a result of the bit being dropped in the hole.

In normal use of the bit shown in FIGS. 8 and 9, the hydraulic pressure of the drilling fluid in the passage 74, which is higher than the hydraulic pressure in the annulus and at the face of the bit, urges the piston assembly 76 downwardly in the cylinder 82 so that the movable bit part 58 is in its lowermost position in relation to the fixed bit part 46. In this position, the main cutting action at the bottom of the hole being drilled is effected by the primary cutting structure comprising the cutters 14 and 15 on the central movable part 58 of the bit. The part 58 may be so positioned normally in relation to the fixed part 46 that when the cutters 14 and 15 are in operation under normal weight-on-bit loads the abrasion elements 56 on the face portions 54 are either out of engagement with the formation or perform only a subsidiary cutting effect on the formation.

However, should there be a momentary or continuing overload on the cutters 14 and 15, resulting in increased weight-on-bit, the overload will cause the central part 58 to retract upwardly relatively to the outer part 46 against the axial restraint provided by the hydraulic pressure of the drilling fluid. This retraction of the central part 58 will re-distribute the loads on the end face of the bit so that the abrasion elements on the secondary cutting structure carry a higher proportion of the load, thus relieving the overload on the more vulnerable cutters 14 and 15.

However, even when the movable part 58 of the bit is bearing the main drilling load, i.e. is not being subjected to excessive weight, impact or the like, the cutter assemblies 14 and 15 are still, of necessity, subjected to a certain amount of heat and, of course, to the drilling forces. In at least some circumstances, the radially outermost cutter assemblies take the brunt of this heat and force, and it is therefore desirable to place a relatively large number of cutter assemblies close together in this area. However, for the same reasons, i.e. the heat and various forces imposed on these cutter assemblies during operation, it is also important that the studs or mounting bodies of these assemblies be well supported by adequate material of the bit body therebetween.

In the lower right-hand corner of FIG. 8, there is shown a row of five cutter assemblies. Beginning at the radially innermost end of the row, the first two cutter assemblies 14 are identical to assemblies 14 of the preceding embodiments. The third cutter assembly **14*a* is in fact one of the assemblies 14, i.e. is identical thereto in form and inclination to the direction of motion (as viewed in a plane, such as FIG. 3, which is parallel to said direction), but has been given the more specific reference character 14*a* to distinguish it from others of the cutter assemblies 14. The fourth cutter assembly 15 in the row is identical to cutter assemblies 15 of the first embodiment described hereinabove. Thus, the centerline of its mounting body or stud is inclined at a different angle to the direction of motion from that of cutter assembly 14*a*. Finally, at the outermost end of the row, the fifth cutter assembly 14*b* is virtually identical to the other assemblies 14, and more specifically assembly 14*a*. More particularly, its inclination to the direction of motion is the same as those of the other assemblies 14, and is therefore different from that of assembly 15**.

Thus, even though the expedient of the present invention may not be needed throughout the entirety of the row as shown, its use in connection with the last three cutter assemblies **14*a*, 15 and 14*b* allows those cutter assemblies to be placed very close together and, in addition, allows the inner ends of their posts or mounting bodies to be angled inwardly toward each other as viewed in the plane of FIG. 8**, i.e. transverse to the plane in which the aforementioned angles of inclination of their centerlines are measured.

What is claimed is:

1. A rotary drill bit for use in drilling or coring holes in subsurface formations comprising a bit body having a shank for connection to a drill string, a plurality of cutter assemblies mounted at the surface of the bit body, and a passage in the bit body for supplying drilling fluid to the surface of the bit body for cooling and cleaning the cutter assemblies, at least some of said cutter assemblies each comprising a cutting portion on a mounting body which is received in a socket in the bit body, the mounting body having a centerline disposed at an angle to the normal direction of forward movement of the cutter assembly in use of the bit, and at least three of the cutter assemblies being disposed closely adjacent one another in a row extending generally radially along the bit body, each two adjacent cutter assemblies in said row of at least three having the centerlines of their mounting bodies inclined at different angles to said normal direction of forward movement thereof as measured in planes parallel to said direction.

2. A rotary drill bit according to claim 1 wherein the surface of the bit body comprises an operative end face and a laterally facing portion, said three cutter assemblies in said row being mounted at the end face of the bit body.

3. A rotary drill bit according to claim 2 wherein alternate cutter assemblies in the row have the centerlines thereof inclined at a first or a second angle respectively to the normal direction of forward movement thereof.

4. A rotary drill bit according to claim 1 wherein there are more than three such cutter assemblies in said row.

5. A rotary drill bit according to claim 1 wherein the difference in inclination between the centerlines of said adjacent cutter assemblies is greater than 30°.

6. A rotary drill bit according to claim 1 wherein one of each two such adjacent cutter assemblies has its centerline inclined at substantially 90° to said normal direction of forward movement, and the other of said cutter assemblies has its centerline inclined at less than 90° to said normal direction of forward movement so as to be inclined rearwardly with respect to said direction.

7. A rotary drill bit according to claim 1 wherein each said cutting portion has a front cutting face and the front cutting faces on said adjacent cutter assemblies are inclined at substantially the same angle to said normal direction of forward movement of the cutter assemblies in use.

8. A rotary drill bit according to claim 1 wherein at least some of said cutter assemblies each comprise a preform tablet having a front cutting face of polycrystalline diamond material and a rear face bonded to a surface on a carrier.

9. A rotary drill bit according to claim 8 wherein said preform tablet comprises a thin, hard facing layer of polycrystalline diamond material bonded to a less hard backing layer, the backing layer having a rear face bonded to said surface on the carrier.

10. A rotary drill bit according to claim 1 wherein at least some of said cutter assemblies each comprise a thin, hard facing layer of polycrystalline diamond material bonded to a less hard backing layer, the diamond layer thereby constituting said cutting portion and the backing layer constituting said mounting body.

11. A rotary drill bit according to claim 1, wherein each said cutting portion has a front cutting face, and one of said adjacent cutter assemblies has said front cutting face extending substantially at right angles to the centerline of the mounting body of the cutter assembly.

12. A rotary drill bit according to claim 1 wherein the bit body, including the sockets for the mounting bodies, is machined from solid metal.

13. A rotary drill bit according to claim 1 wherein the bit body, including the sockets for the mounting bodies, is molded using a powder metallurgy process.

* * * * *

UNITED STATES PATENT AND TRADEMARK OFFICE

CERTIFICATE OF CORRECTION

PATENT NO. : 4,942,933

DATED : July 24, 1990

INVENTOR(S) : John D. Barr et al

It is certified that error appears in the above-identified patent and that said Letters Patent is hereby corrected as shown below:

On the title page at [73], change "Assignee: Reed Tool Company, Ltd., Dyce, Northern Ireland" to --Assignee: Reed Tool Company, Ltd., Aberdeen, Scotland--.

Signed and Sealed this

Thirty-first Day of December, 1991

*Attest:*

HARRY F. MANBECK, JR.

*Attesting Officer*

*Commissioner of Patents and Trademarks*